US010190603B2

(12) United States Patent
Bazaz

(10) Patent No.: US 10,190,603 B2
(45) Date of Patent: Jan. 29, 2019

(54) POWER GENERATION FROM ATMOSPHERIC AIR PRESSURE

(71) Applicant: Spar Energy LLC, Montvale, NJ (US)

(72) Inventor: Gaurav Bazaz, Edgewater, NJ (US)

(73) Assignee: Spar Energy LLC, Montvale, NJ (US)

( * ) Notice: Subject to any disclaimer, the term of this patent is extended or adjusted under 35 U.S.C. 154(b) by 0 days.

(21) Appl. No.: 15/945,171

(22) Filed: Apr. 4, 2018

(65) Prior Publication Data

US 2018/0223877 A1 Aug. 9, 2018

Related U.S. Application Data

(63) Continuation-in-part of application No. 14/142,856, filed on Dec. 29, 2013, now Pat. No. 9,938,963.

(60) Provisional application No. 61/747,240, filed on Dec. 29, 2012.

(51) Int. Cl.

| | |
|---|---|
| ***F03D 7/02*** | (2006.01) |
| ***F04F 5/54*** | (2006.01) |
| ***F04F 5/16*** | (2006.01) |

(52) U.S. Cl.
CPC . *F04F 5/54* (2013.01); *F04F 5/16* (2013.01)

(58) Field of Classification Search
CPC ... F03D 9/002; F03D 9/25; F03D 1/04; F03D 9/30; F03D 9/034; F03D 9/41; F03D 1/00; Y02E 10/725; Y02E 10/72; F03F 9/002; H02D 10/12; Y10S 415/908
USPC ..... 415/218.1, 219.1, 1, 4.3, 4.5, 144, 185, 415/220, 905, 908; 290/44, 55
See application file for complete search history.

(56) References Cited

U.S. PATENT DOCUMENTS

| | | | |
|---|---|---|---|
| 1,045,865 | A | 12/1912 | Magni |
| 1,578,923 | A | 3/1926 | Schlotter |
| 3,750,397 | A | 8/1973 | Cohen et al. |
| 4,066,552 | A | 1/1978 | Caine |
| 4,132,499 | A | 1/1979 | Igra |
| 4,149,374 | A | 4/1979 | Barchenko |
| 6,382,904 | B1 | 5/2002 | Orlov et al. |
| 7,484,929 | B1 * | 2/2009 | Fitzpatrick ..... F04D 17/164 415/116 |
| 8,814,493 | B1 | 8/2014 | Komp |
| 2008/0232957 | A1 | 9/2008 | Presz et al. |
| 2011/0135443 | A1 | 6/2011 | Cucci |
| 2011/0198855 | A1 | 8/2011 | White |

* cited by examiner

*Primary Examiner* — William V Gilbert
(74) *Attorney, Agent, or Firm* — Hard IP LLC; Kinza Hecht

(57) ABSTRACT

An apparatus comprising a channel with an inlet which receives injected air and an outlet through which injected and drawn-in ambient air exit. The channel also comprising of inlet slit and airfoil which help drive flow of ambient air into the channel to increase the mass of air flowing through the channel.

2 Claims, 9 Drawing Sheets

POWER GENERATION FROM ATMOSPHERIC AIR PRESSURE

RELATED APPLICATION

This application is a continuation-in-part application of the U.S. application Ser. No. 14/142,856, filed Dec. 29, 2013, entitled "Power Generation from Atmospheric Air Pressure," which claims priority to U.S. provisional patent application No. 61/747,240, filed Dec. 29, 2012, the entire contents of both are hereby incorporated by reference in their entirety.

FIELD OF INVENTION

The present disclosure relates to power generation from atmospheric air pressure, and more specifically to power generation from clean energy sources, through the use of mechanics of fluid flow.

BACKGROUND

Various known methods are used for generation of useful energy which include burning of fossil fuels. Known methods to generate energy for performing useful work from non-polluting sources include solar and wind energy. However, they suffer from limitations including inconsistent and unpredictable supply, large physical footprint per unit energy production, geographic limitations, long installation times and high initial capital cost. The proposed innovation allows generation of useful energy by conversion of energy stored in the pressure of ambient atmosphere into useful work. The proposed system utilizes known physical phenomena to create local effects that cause the pressure energy of the atmosphere to be converted into kinetic energy of flowing air, which is then tapped to generate useful work.

SUMMARY

An apparatus is disclosed including a flow channel comprising an inlet that receives injected air and an outlet through which a mixture of the injected air and drawn-in ambient air exits, and the flow channel being defined by an enclosure having an exterior surface and an interior surface defining a substantially constant thickness; an aperture, created by a slit extending through the substantially constant thickness, through which ambient air external to the aperture is drawn into the flow channel; and a pressure airfoil at a position on the interior surface of the flow channel and on a same side of the interior surface as the aperture. Additionally, the pressure airfoil is spaced between the aperture and the inlet and along a longitudinal length of the flow channel. Further, the flow channel comprising a velocity airfoil at a second position on the interior surface of the flow channel and on an opposite side of the interior surface as the aperture, the velocity airfoil spaced between the aperture and the inlet and along a longitudinal length of the flow channel.

Additionally, an apparatus comprising a chamber including an inlet that receives injected air and an outlet through which a mixture of the injected air and drawn-in ambient air exits, and a chamber being defined by an enclosure having an exterior surface and an interior surface defining a substantially constant thickness; an internal cone within the chamber between the inlet and the outlet, wherein the internal cone gradually increases in size from the inlet to the outlet, wherein a first end of the internal cone proximate to the inlet is narrower in size than a second end of the internal cone proximate to the outlet; and a flow channel formed by space between the interior surface of the chamber and the internal cone, wherein a first interior surface of the flow channel is the interior surface of the chamber and a second interior surface of the flow channel is an exterior surface of the internal cone, wherein the flow channel comprises: (a) an aperture, created by a slit extending through the substantially constant thickness of the chamber, through which ambient air external to the chamber is drawn into the flow channel; and (b) a velocity airfoil at a position on the second interior surface of the flow channel, the velocity airfoil spaced between the aperture and the inlet and along a longitudinal length of the flow channel. Further, the flow channel comprises a pressure airfoil at a position on the first interior surface of the flow channel, the pressure airfoil spaced between the aperture and the inlet and along a longitudinal length of the flow channel.

DETAILED DESCRIPTION

Figure 1:
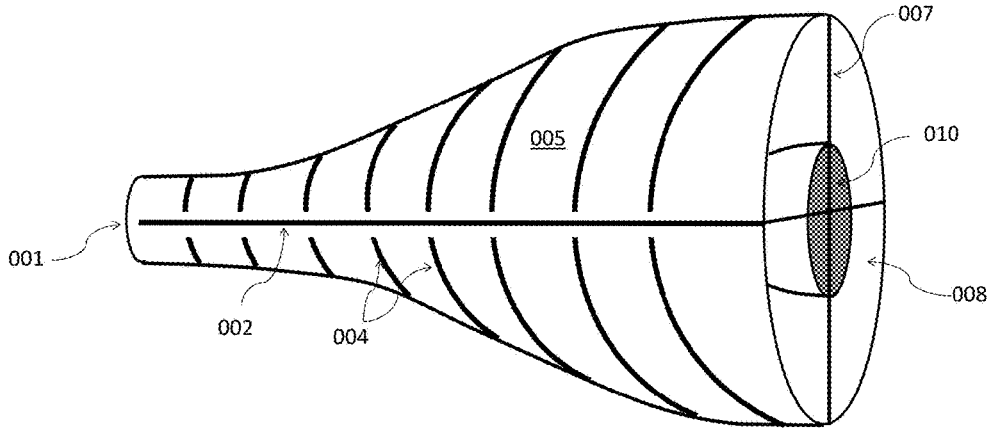
FIG. 1 provides a high level simple external view of the Wind Multiplier Generator ('WMG') apparatus.

Reference will now be made in detail to the implementations of the disclosure, an example of which is illustrated in the accompanying drawing. Wherever possible, the same reference numbers are used in the drawing and the description to refer to the same or like parts.

Aspects and implementations of the present disclosure are directed towards an energy generation system which converts atmospheric air pressure to energy by utilizing known phenomena such as inducement and entrainment. Methods and apparatus are proposed for generating net energy through multiplication of fluid flow and increasing the velocity of flow through an enclosed chamber. Known physical phenomena such as Inducement and Entrainment can be used to increase the mass of fluid in directed flow by drawing stationary fluid from around the flowing fluid into the stream of the flowing fluid. Additionally, nozzles can be used to accelerate and direct the flow in optimal directions to maximize the Entrainment and Inducement efficiency and energy recovery efficiency.

Inducement is a phenomenon wherein the directional flow of a mass of fluid within a larger body of fluid causes the stationary fluid behind the flowing mass to join the directionally flowing mass thereby increasing the total mass that is engaged in directed flow.

Entrainment is a phenomenon wherein the directional flow of a mass of fluid within a larger body of fluid causes the stationary fluid around the flowing mass to join the directionally flowing mass thereby increasing the total mass that is engaged in directed flow.

When a mass of fluid is put into motion through an external force, within a body of the fluid, phenomena such as Inducement and Entrainment can help to dramatically increase the amount of fluid in motion, multiplying the actual fluid in motion compared to the amount originally placed in motion by the external force. Therefore, a limited amount of external force, generating a reasonable flow of fluid, can produce a much larger flow of fluid without application of additional force, through use of structures that manipulate the impelled fluid flow. The increase in mass of flowing fluid results from the conversion of the pressure energy of the stationary fluid to kinetic energy of the flowing fluid. Similarly, when a mass of fluid is pushed through a narrowing channel, the reduction in flow cross-sectional area causes an increase in velocity of flow, in accordance with the Venturi Effect, which in turn causes an increase in the Kinetic Energy of the flow, while reducing the pressure energy of the flow.

Apparatus and methods are proposed that leverage such phenomena to generate net energy. An apparatus is proposed wherein, fluid such as air is pushed in at one end of a chamber using an injector device such as an impeller or fan, which fluid then exits through the other end of the chamber. A turbine within the chamber is turned through the force of the movement of the fluid, which turbine is connected to a generator which produces electric energy. The design of the chamber is such that, natural phenomena such as Inducement and Entrainment are leveraged to increase the total fluid flowing per unit time per unit cross-sectional area along the path of flow, as additional fluid is pulled in from outside the chamber through inlet slits by the natural flow of the fluid within the chamber. Therefore, the total fluid mass per unit time driving the energy producing turbine is considerably greater than the fluid injected into the chamber by the injector at the inlet. Therefore, the power generated by the turbine is greater than the power consumed by the injector and other device components resulting in generation of net positive power. This additional energy is extracted from static pressure of the ambient stationary fluid and is a direct conversion of the pressure energy of the stationary fluid into kinetic energy, which in turn is converted into electric energy by the turbines and generators.

The overall system consists of an (a) injector module, (b) flow multiplier channel and an (c) energy reconversion module. The injector module consists of a fan or impeller like device with other flow directing components which drive stationary fluid into a chamber and direct its flow. Additionally, it might have structural features which produce an initial flow enhancement through use of phenomena such as inducement. The flow multiplier channel receives the flowing mass of fluid and using structural features, enables a significant increase in total flow mass through use of phenomena such as entrainment. Finally, the energy reconversion module receives the enhanced flow from the flow multiplier channel and drives it through a turbine-generator configuration to convert the kinetic energy of the flow to mechanical and electrical energy.

The overall operation consists of the following steps. First the injector draws air from around it using a fan or impeller to inject air into the fluid multiplier channel. The injector consumes energy in imparting directed motion to the air particles. The injector design might also include features that enable inducement and entrainment to enhance the flow generated from the fan or impeller and in turn improve the effective efficiency of the injector. The injected air travels through the flow multiplier channel where various design features cause the stationary ambient air from outside the channel to enter the channel and join the flow within the channel. This process converts the pressure energy of the ambient stationary air into kinetic energy of the flowing air within the channel. The air exiting the flow multiplier channel is now more energetic than the air injected by the injector module on account of the increase in mass of air in the flow stream. This flow stream is then directed to the energy reconversion module where it passes through a turbine. As the energized air passes through the turbine its kinetic energy is converted into the mechanical energy of the rotating turbine, which in turn can be converted into electrical energy by the generators.

While apparatus and operating mechanisms discussed herein apply to most fluids including water, atmospheric air will be used as the exemplar operating fluid to explain the operation of the devices. However, this is not to limit the scope of application of the system to atmospheric air.

In one implementation, the flow multiplier channel consists of a plain tube-like channel with an airfoil and slit on the same side of the tube, adjacent to each other. The airfoil is located upstream of the slit with respect to the direction of flow of injected fluid. As the injected fluid travels through the tube, it hits the airfoil which causes a low-pressure region to develop behind it, near the slit. The low-pressure region near the slit draws ambient air from outside the flow multiplier channel to enter the channel and join the internal flow.

In one implementation, the flow multiplier channel consists of a plain tube-like channel with an airfoil and slit. The airfoil and slit are located on opposite sides of the tube with the airfoil upstream of the slit with respect to the direction of flow of injected fluid. As the injected fluid travels through the tube, it hits the airfoil which causes a low-pressure region to develop behind it, near the slit. The low-pressure region near the slit draws ambient air from outside the flow multiplier channel to enter the channel and join the internal flow.

In another implementation, the flow multiplier channel consists of a plain tube-like channel with multiple airfoils and a slit. An airfoil is located on the same slide as the slit and another airfoil is located on opposite side of the tube from the slit, both upstream of the slit with respect to direction of motion of the injected fluid. As the injected fluid travels through the tube, it hits the airfoils which causes a low-pressure region to develop behind them, near the slit. The low-pressure region near the slit draws ambient air from outside the flow multiplier channel to enter the channel and join the internal flow.

FIG. 1 provides a high level external view of the Wind Multiplier Generator ('WMG') apparatus. The apparatus consists of an inlet 001 from where fluid in injected, an outlet 008 from where the injected fluid exits the apparatus, an external cone 005, an internal cone 010, a cross-ribs structures 002 and 007 which hold the internal cone 010 and external cone 005 together. The external cone 005 also has inlet slits 004 all along its surface. The space between the internal cone 010 and external cone 005 forms the Flow Channel ('FC') through which the fluid injected at inlet 001 flows. The inlet slits 004 provide an entry passageway from which any fluid outside the WMG apparatus can enter into the apparatus and join the fluid flowing in the Flow Channel.

Figure 2:
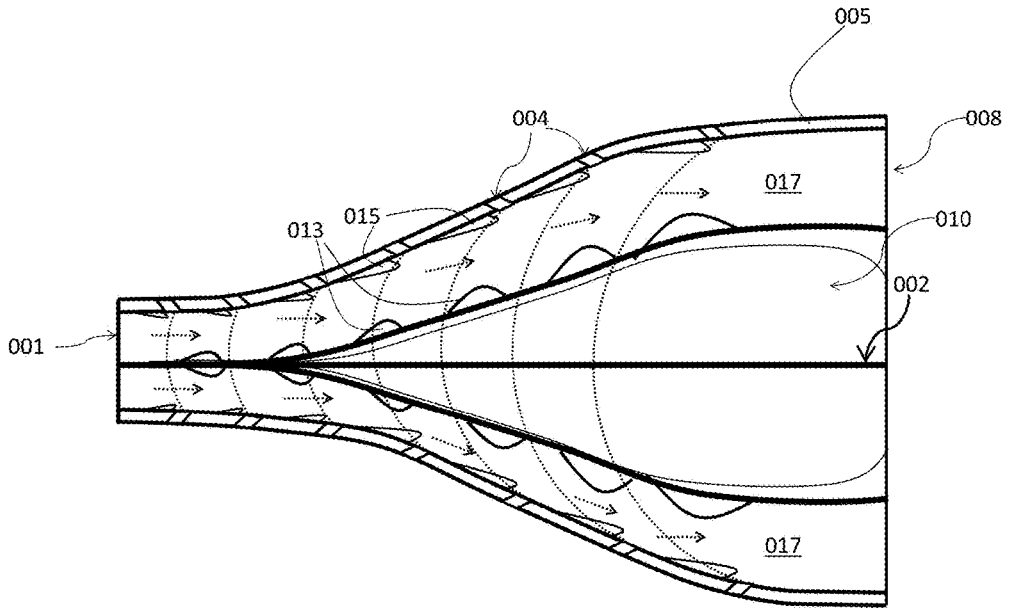
FIG. 2 provides detailed view of the inside of the WMG apparatus, in a simple cross-section view. This figure also explains the mode of operation of the apparatus.

FIG. 2 provides a detailed cross-sectional internal view of the WMG apparatus. The view provided here is what a one would see if the apparatus was cut in half across its center line. Visible again is the inlet 001, the outlet 008, the inner cone 010, the outer cone 005, the cross-rib 002 and the side slit inlets 004. Also visible are the Pressure Airfoils 015 and Velocity Airfoils 013. All airfoils on the outer cone 005 are Pressure Airfoils, while all airfoils on the inner cone 010 are Velocity Airfoils. The fluid is injected into the WMG apparatus at the inlet 001, at a high speed, at least above 50 meters per second and below 350 meters per second. For sake of simplicity, rest of the explanation will assume the fluid injected to be Air, though in practice it may be any fluid including water or a mixture of fluids. As the injected air travels through the Flow Channel 017, as shown by the dotted arrows, it slips past the walls of the inner and outer cones, and also along the surface of the Pressure and Velocity airfoils. As the injected air flows past the inlet slits 004, due to entrainment, it pulls the stationary air near the slits along into the flow. Additionally, as the injected air flows past the Velocity Airfoils 013, it picks up speed due to the constriction of the Flow Channel caused by these airfoils, resulting in the Venturi Effect. As the injected air flows past the Pressure Airfoils 015, it creates a region of low pressure near the slits 004, which are adjacent to the Pressure Airfoils. This is normal fluid dynamics behavior where low-pressure regions are created behind a solid body in the flow. This low pressure is low relative to the pressure of the stationary atmospheric air outside the apparatus, on the other side of the slits. Due to this pressure difference, between the flowing air in the Flow Channel 017, and the atmospheric air outside, the air outside rushes into the Flow Channel 017 and joins the existing flow. At each slit 004, the same phenomenon is repeated and more air is pulled from outside into the Flow Channel 017 and joins the flow of air inside the WMG apparatus. As a result, the mass of air exiting the apparatus at outlet 008 is much greater than the mass of air injected into the apparatus at inlet 001. Since the total mass of air exiting the apparatus is much greater, than the mass injected, if the drop in velocity of flow at the outlet is relatively small enough, than the apparatus allows for a net gain in Kinetic Energy. The exiting flow is used to power a turbine which works with an electric generator to produce electrical power. The turbine and generator apparatus are not shown here as they are freely available apparatus.

Figure 3:
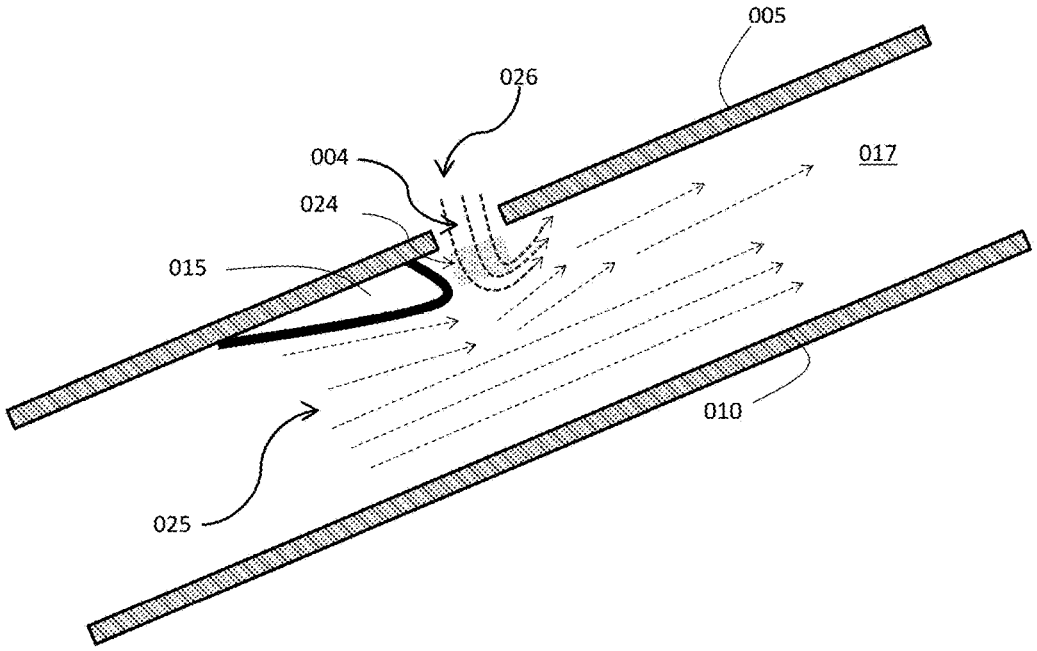
FIG. 3 provides an explanation of the workings of the Permanent Low-Pressure system.

FIG. 3 provides a more detailed view of the inlet slits 004 and how the Permanent Low-Pressure System ('PLPS'), one of the major innovations presented here, works. Note, the words 'fluid' and 'air' are used here interchangeably, and the PLPS systems works with any fluid, air being just one of the possible fluids. Visible is a close-up view of one section of the WMG apparatus, where we have the external cone 005, the internal cone 010, the Pressure Airfoil 015 and the inlet slit 004. The Velocity Airfoil has not been shown for simplicity, and also because it is not required for the PLPS. As the injected fluid 025 flows in the Flow Channel 017, it goes past the Pressure Airfoil 015. As it goes past, a region of low pressure 024 is created behind the Pressure Airfoil 015, near the inlet slit 004. Due to the pressure difference phenomena explained in FIG. 2, atmospheric ambient air 026 outside the apparatus rushes into the Flow Channel 017 through the slit 004. However, since the low-pressure region is not enclosed, and the injected air 025 is still flowing in the Flow Channel, this external air 026 joins the injected air 025 and continues to flow in the Flow Channel, away from the low-pressure region 024. As a result, the low-pressure region 024 is never equalized with the ambient pressure, and continues to hold its lower pressure state, in spite of air flowing through it constantly, and having higher pressure regions surrounding it. This PLPS acts as a permanent mechanism to draw in air from outside the apparatus, while requiring no additional energy to be expended to maintain it. Energy is only expended when the low-pressure region is first created, and not after that. This is a unique innovation which allows fluid flow to be caused, utilizing the inherent atmospheric pressure of the ambient fluid, and requiring no additional expense of energy.

Figure 4:
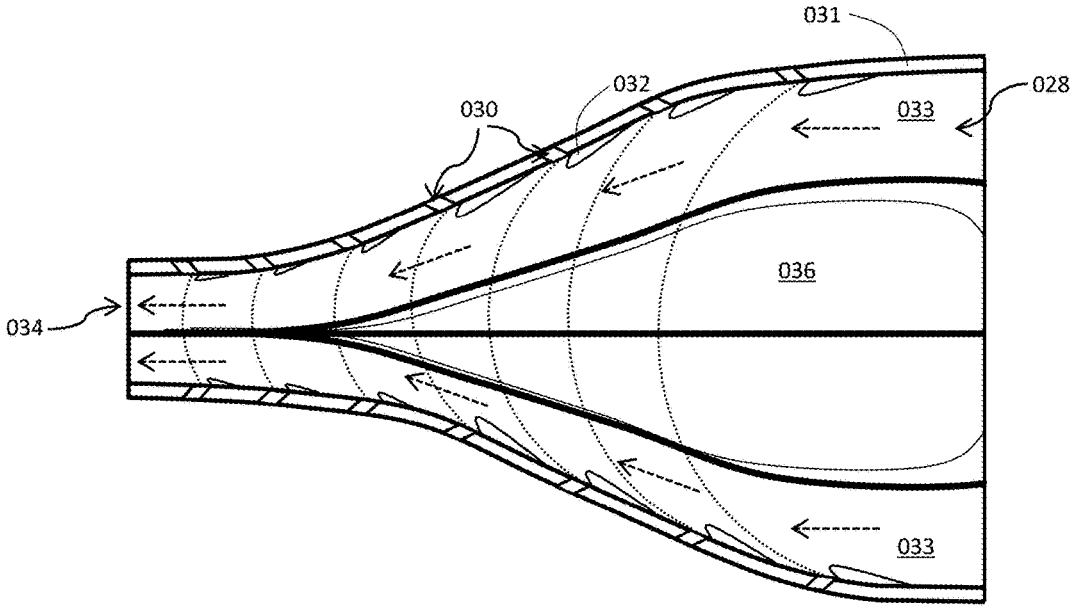
FIG. 4 provides a detailed view of the inside of the Venturi Pressure Converter Generator ('VPCG') apparatus, including its mode of operation.

FIG. 4 provides a detailed internal cross-section view of the Venturi Pressure Converter Generator ('VPCG') model. The view provided here is what would be visible if the apparatus was cut in half across its center line. Note, the words 'fluid' and 'air' are used here interchangeably, and the PLPS systems works with any fluid, air being just one of the possible fluids. The apparatus is very similar to the WMG apparatus, except the direction of fluid flow is reversed. Also, the direction of the Pressure Airfoils is reversed in accordance with the direction of fluid flow. The apparatus consists of the inner cone 036, the outer cone 031, the Flow Channel 033, side slit inlets 030, Velocity Airfoils 032, inlet 028 and outlet 034. The fluid is injected from the inlet 028 and exits the apparatus from the outlet 034. As the fluid flows through the apparatus in the Flow Channel 033, it uses the same phenomena as the WMG apparatus to increase the mass of fluid in flow in the Flow Channel, so that the mass of air flowing out at outlet 034 is greater than the mass of fluid injected at inlet 028. However, in addition, the Flow Channel becomes narrower along the direction of flow, so that the outlet cross-section area is much smaller than the inlet cross-section area. This results in a considerable increase in the velocity of fluid flow in the Flow Channel 033, due to the Venturi Effect. Therefore, the fluid flows out from the outlet 034 at a higher velocity than the velocity at which it was injected at the inlet 028. The increase in velocity represents an increase in Kinetic Energy, so that the device increases the kinetic energy of the flow both from increase in mass of flowing fluid as well as through increase in velocity of the flowing fluid. Therefore, the kinetic energy of the fluid when flowing out from the outlet 034 is much higher than the energy expended to inject the fluid at inlet 028. This increase in energy can be utilized to drive a turbine which paired with a generator can generate electric energy. A gain in net energy can be achieved as the energy extracted from the fluid at the outlet, can be much higher than the energy expended to inject the fluid at the inlet.

Figure 5:
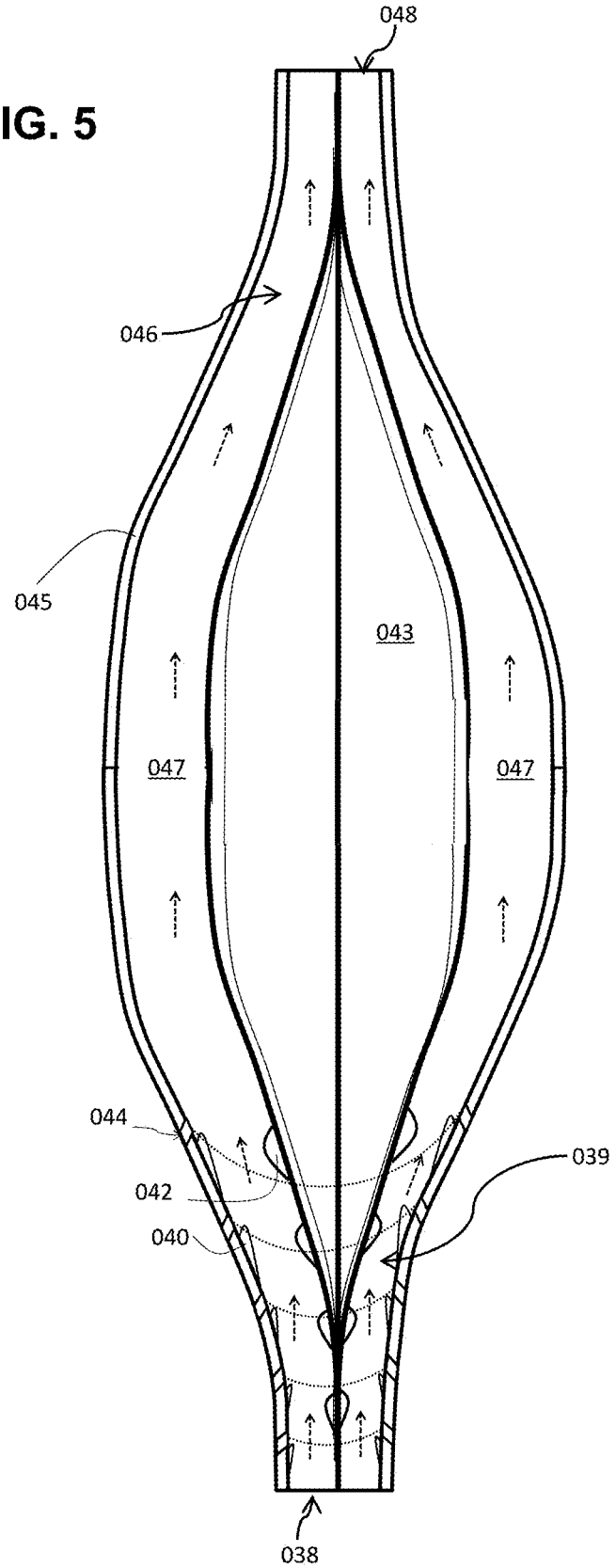
FIG. 5 provides a detailed view of the inside of the Hybrid Venturi Multiplier Generator ('HVMG') apparatus, including its mode of operation.

FIG. 5 is a detailed view of the inside of the Hybrid Venturi Multiplier Generator ('HVMG') apparatus. The view visible is what one would see if the apparatus was cut in half along its center line. The apparatus consists of the inner cone 043, the outer cone 045, the inlet 038, the outlet 048, the Flow Channel 047, the Pressure Airfoils 040, the Velocity Airfoils 042 and the inlet slits 044. The apparatus consists of two regions, the Mass Multiplication Region 039 and the Venturi Compression Region 046. Fluid is injected from the inlet 038 and flows across the Flow Channel 047. As it runs past the inlet slits 044, the Velocity Airfoils 042 and the Pressure Airfoils 040, the same mode of operation as explained for the WMG apparatus, in FIG. 2, is seen.

Ambient fluid from outside the apparatus is pulled in through the inlet slits 044, into the Flow Channel 047. This results in an increase in the mass of fluid flowing through the apparatus in the Flow Channel, in the Mass Multiplication Region 039. As the fluid moves through the Flow Channel 047, and through the Venturi Compression Region 046, it experiences the Venturi Effect due to narrowing Flow Channel, as a result of which the fluid velocity increases. Therefore, we get an increase in mass of flowing fluid as well as increase in velocity, but in different regions. As a result, the total mass of fluid exiting the apparatus at outlet 048 is more than the mass injected at inlet 038. Additionally, the velocity of fluid at outlet may be almost same or higher than the velocity at which it was injected.

Figure 6:
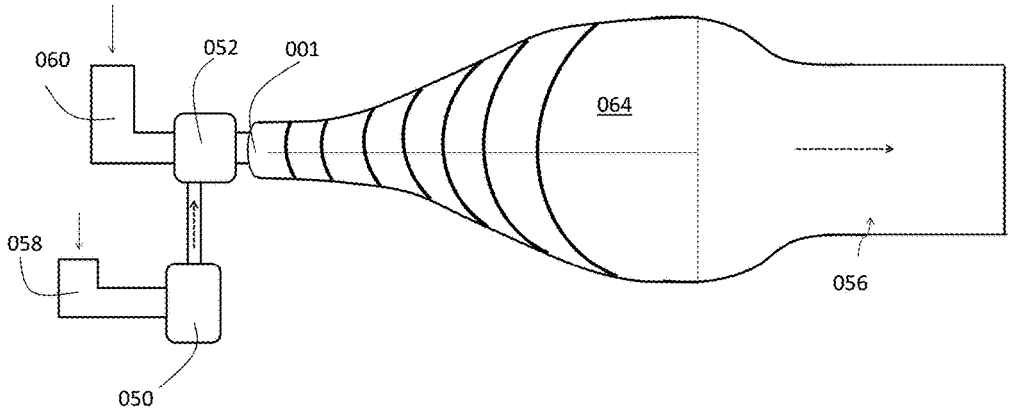
FIG. 6 provides a high level simplified schematic explaining the overall setup within which the WMG apparatus may be placed for production operation. The same setup, with minor modifications, may be used for the VPCG and HVMG apparatus as well.

FIG. 6 provides a high level simplified schematic explaining the overall setup within which the WMG apparatus may be placed for production operation. The same setup, with minor modifications, may be used for the VPCG and HVMG apparatus as well. The explanation below uses Air as the operating fluid, but the apparatus works for any fluid. A turbofan 050 is run at high speeds to draw in ambient air from an inlet duct 058. The turbofan injects the air into an Injection Ring 052. The Injection Ring 052 redirects the flow of the air into the inlet 001 of the WMG apparatus. Also, the Injection Ring 052, uses the phenomena of Inducement to pull in additional ambient air through the Inducement Duct 060. The injected fluid passes through the WMG apparatus 064, and then exits through the reconversion channel 056, where a turbine is placed to convert the kinetic energy of the flowing fluid into mechanical energy, which is then converted to electrical energy by the generator.

Figure 7:
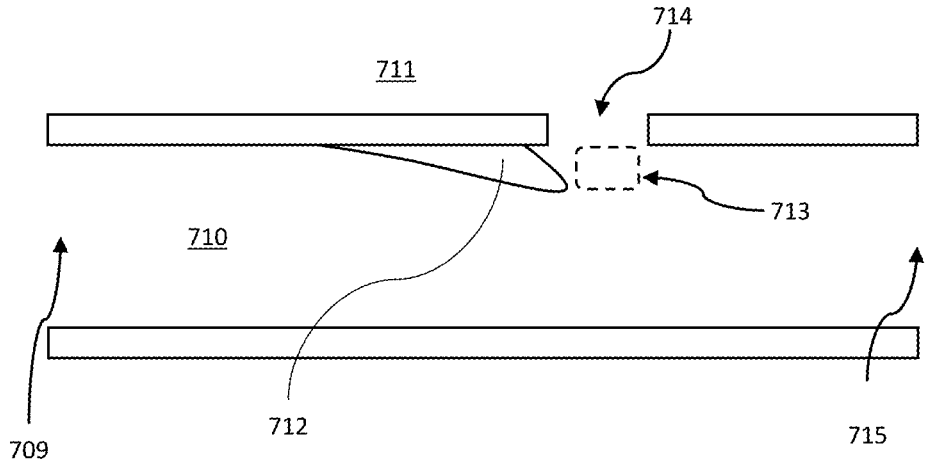
FIG. 7 provides a simplified view of the implementation of the flow multiplier channel comprising of a fluid flow channel with a slit and airfoil on the same side as the slit.

FIG. 7 provides a detailed view of the implementation of a flow multiplier channel comprising a fluid flow channel with a slit and airfoil on the same side as the slit. The system includes a flow channel 710 through which the injected air flows. The injected air flows from the inlet 709 on the left side to the outlet 715 on the right side as depicted in the FIG. 7. Further, a slit 714 is provided on an upper side of the flow channel 710 and a pressure airfoil 712 is included adjacent to the slit 714, specifically, the airfoil 712 is located to the left side of the slit 714. As defined herein, a pressure airfoil is an airfoil located adjacent to a slit, while a velocity airfoil is an airfoil located opposite to a slit. As the injected air travels across the flow channel 710 from the inlet 709 to the outlet 715, the injected air passes by the airfoil 712. As the injected air passes by the airfoil 712, a low-pressure region 713 is created behind the airfoil 712 right where the slit 714 is located. The low-pressure region 713 does not have fixed boundaries, therefore the representation in FIG. 7 is indicative, not exact. In an implementation, the air flow, airfoil and slit are designed such that the static pressure of air behind the airfoil 712, at the slit 714, may be less than the static pressure of ambient air 711 outside the flow multiplier channel. As a result, ambient air 711 from outside the flow multiplier channel is pulled inside through the slit 714 and the ambient air 711 from the outside joins the flow in the flow channel 710. Therefore, a total mass of air exiting the flow channel 710 is more than the total mass of air injected into it because the drawn-in ambient air 711 from outside the flow channel 710 is now part of the flow within the flow channel 710. As long as air is injected into the flow channel 710 through the inlet 709, a low-pressure region 713 will be maintained behind the airfoil 712, causing ambient air 711 to be drawn into the flow channel 710 through the slit 714. When air is no longer injected into flow channel 710 through the inlet 709, the low-pressure region 713 no longer persists and therefore ambient air 711 is no longer drawn into the flow channel 710. In order to generate energy, a turbine-generator machine is functionally connected to the outlet 715 of the flow channel 710. The air mass exits the flow channel 710 through the outlet 715 and enters the turbine, not shown in the drawings, where it drives the turbine which in turn drives the generator to produce electricity. The turbine-generator can be replaced with other machinery which can translate the energetic air flow into useful work.

The flow channel of FIG. 7 is essentially a channel which allows for substantially unimpeded flow of air, or other fluids, without suffering from significant leakage of the air flowing through it. It can be of any cross-sectional shape, including square, rectangle or circle and of a length large enough to allow for placement of the pressure airfoil 712 and slit 714. The cross-sectional size of the flow channel can be varied across a large range of dimensions but should minimally accommodate the pressure airfoil 712 in such a way that the flow of air in the flow channel 710 is not blocked by the airfoil 712. The cross-sectional shape of the flow channel can vary along its length. The apparatus described in FIG. 7 can be rotated with respect to surface of the earth, in any direction, without sacrificing its functional capability, as long as the location of all the elements comprising the apparatus, with respect to each other, is unchanged. The pressure airfoil 712 is a structure which modifies the flow of air through the channel 710 by forcing the air to travel around it. The pressure airfoil 712 can be a solid structure or a shell, but is not porous, thereby air striking the airfoil is forced to travel around it and not through it. The purpose of the pressure airfoil 712 is to modify the flow of the air through the channel 710 in such a way as to create a region of low pressure near the slit 714. The formation of this low-pressure region 713 near the slit causes ambient air 711 to enter the flow channel 710 through the slit 714. The exact geometrical shape of the pressure airfoil 712 can be varied across many different possibilities. Any geometrical shape which causes a low-pressure region to develop substantially near the slit 714, is acceptable to achieve the desired functionality. The slit 714 is essentially an opening in the flow channel 710, along its length. The size of the slit 714 can be varied to achieve maximum inflow of ambient air 711 into the flow channel 710 and will vary depending on shape of pressure airfoil 712 and flow channel 710. Generally, if the slit is too narrow it will limit the amount of ambient air 711 that gets drawn-in to the flow channel 710. If the slit is too large, it will allow the air flowing within the flow channel 710 to escape out. Therefore, the size of the slit needs to strike a balance to maximize the inflow of ambient air 711 into the flow channel while precluding the outflow of air from within the flow channel 710 through the slit 714. Above elements can be physically realized using various known materials including, but not limited to, metal, plastics, wood, glass, among others.

Figure 8:
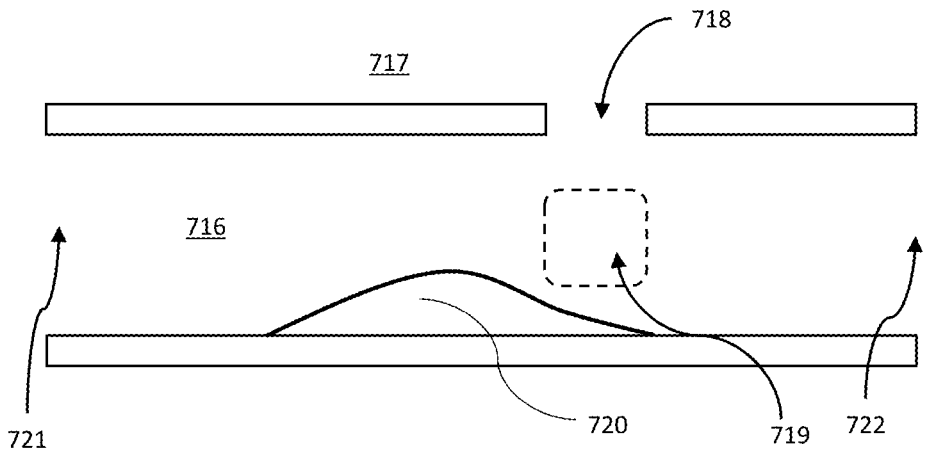
FIG. 8 provides a simplified view of the implementation of the flow multiplier channel comprising of a fluid flow channel with a slit and airfoil on opposites sides.

FIG. 8 provides a detailed view of the implementation of the flow multiplier channel comprising of a fluid flow channel with a slit and airfoil on opposites sides. The system comprises of a flow channel 716 through which injected air flows. The injected air flows from the inlet 721 on the left side to the outlet 722 on the right side as depicted in FIG. 8. Further, a slit 718 is provided on an upper side of the flow channel 716 and a velocity airfoil 720 is provided opposite the slit 718. Specifically, the airfoil 720 is located to the left side of the slit 718 as depicted in the FIG. 8. As defined herein, a velocity airfoil is an airfoil placed opposite a slit, while a pressure airfoil is an airfoil placed adjacent to a slit. As the injected air travels past the airfoil 720, it results in a region of low static pressure 719 forming behind the airfoil 720 opposite to the inlet slit 718. The low-pressure region 719 does not have fixed boundaries, therefore the representation in FIG. 8 is indicative, not exact. The flow channel 716, airfoil 720 and slit 718 are designed such that the static pressure behind the airfoil 720 is less than the static pressure of the ambient air 717. As a result, the ambient air 717 is pulled into the flow channel 716, through the slit 718, and joins the flow inside the flow multiplier channel. As a result, the total mass of air exiting the flow channel 716 is more than the total mass injected into it because the drawn-in ambient air 717 from outside the flow channel 716 is now part of the flow within the flow channel 716. As long as air is injected into the flow channel 716 through the inlet 721, a low-pressure region 719 will be maintained behind the airfoil 720, causing ambient air 717 to be drawn into the flow channel 716 through the slit 718. When air is no longer injected into flow channel 716 through the inlet 721, the low-pressure region 719 no longer persists and therefore ambient air 717 is no longer drawn into the flow channel 716. In order to generate energy, a turbine-generator machine is functionally connected to the outlet 722 of the flow channel 716. The air mass exits the flow channel 716 through the outlet 722 and enters the turbine, not shown in the drawings, where it drives the turbine which in turn drives the generator to produce electricity. The turbine-generator can be replaced with other machinery which can translate air flow into useful work.

The flow channel of FIG. 8 is essentially a channel which allows for substantially unimpeded flow of air, or other fluids, without suffering from significant leakage of the air flowing through it. It can be of any cross-sectional shape, including square, rectangle or circle and of a length large enough to allow for placement of the velocity airfoil 720 and slit 718. The cross-sectional size of the flow channel can be varied across a large range of dimensions but should minimally accommodate the velocity airfoil 720 in such a way that the flow of air is not blocked by the airfoil 720. The cross-sectional shape of the flow channel can vary along its length. The apparatus described in FIG. 8 can be rotated with respect to surface of the earth, in any direction, without sacrificing its functional capability, as long as the location of all the elements comprising the apparatus, with respect to each other, is unchanged. The velocity airfoil 720 is a structure which modifies the flow of air through the channel 716 by forcing the air to travel around it. The velocity airfoil 720 can be a solid structure or a shell, but is not porous, thereby air striking the airfoil is forced to travel around it and not through it. The purpose of the velocity airfoil 720 is to modify the flow of the air through the channel 716 in such a way as to create a region of low pressure near the slit 718. The formation of this low-pressure region 719 near the slit causes ambient air 717 to enter the flow channel 716 through the slit 718. The exact geometrical shape of the velocity airfoil 720 can be varied across many different possibilities. Any geometrical shape which causes a low-pressure region to develop substantially near the slit 718, is acceptable to achieve the desired functionality. The slit 718 is essentially an opening in the flow channel 716, along its length. The size of the slit 718 can be varied to achieve maximum inflow of ambient air 717 into the flow channel 716 and will vary depending on shape of velocity airfoil 720 and flow channel 716. Generally, if the slit is too narrow it will limit the amount of ambient air 717 that gets drawn-in to the flow channel 716. If the slit is too large, it will allow the air flowing within the flow channel 716 to escape out. Therefore, the size of the slit will need to strike a balance to maximize the inflow of ambient air 717 into the flow channel while precluding the outflow of air from within the flow channel 716 through the slit 718. Above elements can be physically realized using various known materials including, but not limited to, metal, plastics, wood, glass, among others.

Figure 9:
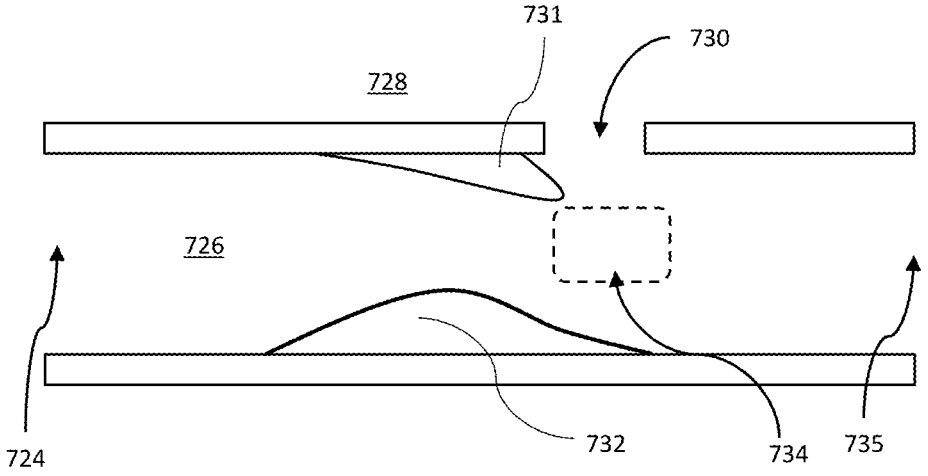
FIG. 9 provides a simplified view of the implementation of the flow multiplier channel comprising of a fluid flow channel with a slit and airfoil on same side and opposite side as the slit.

FIG. 9 provides a detailed view of the implementation of a flow multiplier channel comprising a fluid flow channel with a slit and airfoils on the same side as the slit and opposite side as the slit. The system includes a flow channel 726 through which the injected air flows. The injected air flows from the inlet 724 on the left side to the outlet 735 on the right side as depicted in the FIG. 9. Further, a slit 730 is provided on an upper side of the flow channel 726 and a pressure airfoil 731 is included adjacent to the slit 730, specifically, the airfoil 731 is located to the left side of the slit 730 in FIG. 9. Additionally, a velocity airfoil 732 is located opposite the slit 730, to the left of the slit 730, as provided in FIG. 9. As defined herein, a pressure airfoil is an airfoil located adjacent to a slit, while a velocity airfoil is an airfoil located opposite to a slit. As the injected air travels across the flow channel 726 from the inlet 724 to the outlet 735, the injected air passes by the airfoils 731 and 732. As the injected air passes by the airfoils 731 and 732, a low-pressure region 734 is created behind the airfoils 731 and 732 where slit 730 is located. The low-pressure region 734 does not have fixed boundaries, therefore the representation in FIG. 9 is indicative, not exact. In an implementation, the air flow, airfoils and slit are designed such that the static pressure of air behind the airfoils 731 and 732, at the slit 730, may be less than the static pressure of ambient air 728 outside the flow multiplier channel. As a result, ambient air 728 from outside the flow multiplier channel is pulled inside through the slit 730 and the ambient air 728 from the outside joins the flow in the flow channel 726. Therefore, a total mass of air exiting the flow channel 726 is more than the total mass of air injected into it because the drawn-in ambient air 728 from outside the flow channel 726 is now part of the flow within the flow channel 726. As long as air is injected into the flow channel 726 through the inlet 724, a low-pressure region will be maintained behind the airfoils 731 and 732, causing ambient air 728 to be drawn into the flow channel 726 through the slit 730. When air is no longer injected into flow channel 726 through the inlet 724, the low-pressure region 734 no longer persists and therefore ambient air 728 is no longer drawn into the flow channel 726. In order to generate energy, a turbine-generator machine is functionally connected to the outlet 735 of the flow channel 726. The air mass exits the flow channel 726 through the outlet 735 and enters the turbine, not shown in the drawings, where it drives the turbine which in turn drives the generator to produce electricity. The turbine-generator can be replaced with other machinery which can translate the air flow into useful work.

The flow channel of FIG. 9 is essentially a channel which allows for substantially unimpeded flow of air, or other fluids, without suffering from significant leakage of the air flowing through it. It can be of any cross-sectional shape, including square, rectangle or circle and of a length large enough to allow for placement of the pressure airfoil 731, velocity airfoil 732 and slit 730. The cross-sectional size of the flow channel can be varied across a large range of dimensions but should minimally accommodate the pressure airfoil 731 and velocity airfoil 732 in such a way that the flow of air in the flow channel 726 is not blocked by the airfoils 731 and 732. The cross-sectional shape of the flow channel can vary along its length. The apparatus described in FIG. 9 can be rotated with respect to surface of the earth, in any direction, without sacrificing its functional capability, as long as the location of all the elements comprising the apparatus with respect to each other, is unchanged. The pressure airfoil 731 and velocity airfoil 732 are structures which modify the flow of air through the channel 726 by forcing the air to travel around them. The pressure airfoil 731 and velocity airfoil 732 can be solid structures or shells, but are not porous, thereby air striking the airfoils is forced to travel around and not through them. The purpose of the airfoils 731 and 732 is to modify the flow of the air through the channel 726 in such a way as to create a region of low pressure near the slit 730. The formation of this low-pressure region 734 near the slit causes ambient air 728 to enter the flow channel 726 through the slit 730. The exact geometrical shape of the pressure airfoil 731 and velocity airfoil 732 can be varied across many different possibilities. Any combination of geometrical shapes which cause a low-pressure region to develop substantially near the slit 730, is acceptable to achieve the desired functionality. The slit 730 is essentially an opening in the flow channel 726, along its length. The size of the slit 730 can be varied to achieve maximum inflow of ambient air 728 into the flow channel 726 and will vary depending on shape of pressure airfoil 731, velocity airfoil 732 and flow channel 726. Generally, if the slit is too narrow it will limit the amount of ambient air 728 that gets drawn-in to the flow channel 726. If the slit is too large, it will allow the air flowing within the flow channel 726 to escape out. Therefore, the size of the slit needs to strike a balance to maximize the inflow of ambient air 728 into the flow channel while precluding the outflow of air from within the flow channel 728 through the slit 730. Above elements can be physically realized using various known materials including, but not limited to, metal, plastics, wood, glass, among others.

Although the figures provide exemplary views that may vary in appearance from one another, all elements features described with respect to one figure may apply to another figure. Furthermore, various elements may be interchangeable. For example, one of velocity airfoils 013, depicted in FIG. 2 may be similar to velocity airfoil 720, depicted in FIG. 8. In other implementations, various elements similarly named may differ from one figure to another.

For purposes of this disclosure, any element mentioned in the singular may also include the plural, and vice versa.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Reference throughout this specification to "an implementation" or "one implementation" means that a particular feature, structure, or characteristic described in connection with the implementation is included in at least one implementation. Thus, the appearances of the phrase "an implementation" or "one implementation" in various places throughout this specification are not necessarily all referring to the same implementation.

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

Whereas many alterations and modifications of the disclosure may no doubt become apparent to a person of ordinary skill in the art after having read the foregoing description, it is to be understood that any particular example shown and described by way of illustration is in no way intended to be considered limiting. Therefore, references to details of various examples are not intended to limit the scope of the claims, which in themselves recite only those features regarded as the disclosure.

It will be apparent to those skilled in the art that various modifications and variation can be made to the structure of the present disclosure without departing from the scope or spirit of the disclosure. In view of the foregoing, it is intended that the present disclosure cover modifications and variations of this disclosure provided they fall within the scope of the following claims and their equivalents.

The invention claimed is:

1. An apparatus comprising:

a chamber including an inlet that receives injected air and an outlet through which a mixture of the injected air and drawn-in ambient air exits, the chamber being defined by an enclosure having an exterior surface and an interior surface defining a substantially constant thickness;

an internal cone within the chamber between the inlet and the outlet, wherein the internal cone gradually increases in size from the inlet to the outlet, wherein a first end of the internal cone proximate to the inlet is narrower in size than a second end of the internal cone proximate to the outlet; and a flow channel formed by space between the interior surface of the chamber and the internal cone, wherein a first interior surface of the flow channel is the interior surface of the chamber and a second interior surface of the flow channel is an exterior surface of the internal cone, wherein the flow channel comprises:

an aperture, created by a slit extending through the substantially constant thickness of the chamber, through which ambient air external to the chamber is drawn into the flow channel; and a velocity airfoil at a position on the second interior surface of the flow channel, the velocity airfoil spaced between the aperture and the inlet and along a longitudinal length of the flow channel.

2. The apparatus of claim 1, wherein the flow channel comprises:

a pressure airfoil at a position on the first interior surface of the flow channel, the pressure airfoil spaced between the aperture and the inlet and along the longitudinal length of the flow channel.

* * * * *